US011769372B2

(12) United States Patent
Milosevich et al.

(10) Patent No.: US 11,769,372 B2
(45) Date of Patent: Sep. 26, 2023

(54) SYSTEMS AND METHODS USING MODIFIABLE GAME ELEMENTS

(71) Applicant: LNW Gaming, Inc., Las Vegas, NV (US)

(72) Inventors: Richard Milosevich, Las Vegas, NV (US); Kenneth Shawn Soong, Henderson, NV (US)

(73) Assignee: LNW Gaming, Inc., Las Vegas, NV (US)

( * ) Notice: Subject to any disclaimer, the term of this patent is extended or adjusted under 35 U.S.C. 154(b) by 193 days.

(21) Appl. No.: 17/316,792

(22) Filed: May 11, 2021

(65) Prior Publication Data

US 2022/0028220 A1 Jan. 27, 2022

Related U.S. Application Data

(60) Provisional application No. 63/054,530, filed on Jul. 21, 2020.

(51) Int. Cl.
*G07F 17/32* (2006.01)

(52) U.S. Cl.
CPC ..... *G07F 17/3267* (2013.01); *G07F 17/3213* (2013.01); *G07F 17/3244* (2013.01)

(58) Field of Classification Search
CPC ..... G07F 17/3267; G07F 17/3213; G07F 17/3244

(Continued)

(56) References Cited

U.S. PATENT DOCUMENTS 3,733,075 A 5/1973 Burnside et al.
5,342,047 A 8/1994 Heidel et al.

(Continued)

FOREIGN PATENT DOCUMENTS

AU 2015210489 A1 2/2016
GB 2097160 B 5/1984

(Continued)

OTHER PUBLICATIONS

Zodiac Lion Class III Slot Game; IGT; Casino Journal, Mar. 5, 2020.

(Continued)

*Primary Examiner* — Jay Trent Liddle
*Assistant Examiner* — Ryan Hsu

(57) ABSTRACT

A gaming machine comprises game-logic circuitry and a display device that presents a plurality of symbol positions and modifier positions. The game-logic circuitry causes the display device to present (i) a modifier outcome by populating one or more modifier positions with modifier symbols, and (ii) an animation of one or more symbol positions being populated with value-bearing symbols having award indicia in response to the modifier outcome including a first modifier symbol at a first modifier position. The game-logic circuitry increases, for a preexisting value-bearing symbol prior to the modifier outcome, the award value of the preexisting value-bearing symbol, wherein the display device presents an updated award indicia based on the increased award value, removes, in response to a termination condition, any locked value-bearing symbols from the symbol positions, and provides an aggregated award as a function of the award values of the locked value-bearing symbols occupying the symbol positions.

24 Claims, 9 Drawing Sheets

(58) Field of Classification Search
USPC ..... 463/20
See application file for complete search history.

(56) References Cited

U.S. PATENT DOCUMENTS

| | | | |
|---|---|---|---|
| 5,356,140 | A | 10/1994 | Dabrowski et al. |
| 5,393,061 | A | 2/1995 | Manship et al. |
| 5,704,835 | A | 1/1998 | Dietz |
| 5,833,537 | A | 11/1998 | Barrie |
| 5,951,397 | A | 9/1999 | Dickinson |
| 6,027,115 | A | 2/2000 | Griswold et al. |
| 6,056,642 | A | 5/2000 | Bennett |
| 6,089,977 | A | 7/2000 | Bennett |
| 6,224,482 | B1 | 5/2001 | Bennett |
| 6,251,013 | B1 | 6/2001 | Bennett |
| 6,270,411 | B1 | 8/2001 | Gura et al. |
| 6,290,600 | B1 | 9/2001 | Glasson |
| 6,517,432 | B1 | 2/2003 | Jaffe |
| 6,551,187 | B1 | 4/2003 | Jaffe |
| 6,561,900 | B1 | 5/2003 | Baerlocher et al. |
| 6,641,477 | B1 | 11/2003 | Dietz |
| 6,657,923 | B2 | 12/2003 | Laughlin |
| 6,731,313 | B1 | 5/2004 | Kaminkow |
| 6,786,818 | B1 | 9/2004 | Rothschild et al. |
| 6,837,790 | B1 | 1/2005 | Kaminkow |
| 6,869,360 | B2 | 3/2005 | Marks et al. |
| 6,910,962 | B2 | 6/2005 | Marks et al. |
| 7,018,293 | B2 | 3/2006 | Brown et al. |
| 7,029,396 | B2 | 4/2006 | Jaffe et al. |
| 7,121,945 | B2 | 10/2006 | Suganuma et al. |
| 7,179,169 | B2 | 2/2007 | Beaulieu et al. |
| 7,252,591 | B2 | 8/2007 | Van Asdale |
| 7,458,890 | B2 | 12/2008 | Loose et al. |
| 7,503,847 | B2 | 3/2009 | Baerlocher |
| 7,553,231 | B2 | 6/2009 | Rodgers et al. |
| 7,604,538 | B2 | 10/2009 | Pacey |
| 7,980,936 | B2 | 7/2011 | Mead |
| 8,083,581 | B2 | 12/2011 | Marks et al. |
| 8,105,151 | B2 | 1/2012 | Caputo et al. |
| 8,162,741 | B2 | 4/2012 | Wadleigh et al. |
| 8,192,275 | B2 | 6/2012 | Aoki et al. |
| 8,287,357 | B2 | 10/2012 | Evans |
| 8,323,091 | B2 | 12/2012 | Frank et al. |
| 8,357,041 | B1 | 1/2013 | Saunders |
| 8,360,851 | B2 | 1/2013 | Aoki et al. |
| 8,366,538 | B1 | 2/2013 | Saunders et al. |
| 8,371,930 | B1 | 2/2013 | Saunders et al. |
| 8,414,380 | B2 | 4/2013 | Saunders et al. |
| 8,465,358 | B2 | 6/2013 | Kemper |
| 8,496,522 | B2 | 7/2013 | Caputo et al. |
| 8,512,138 | B2 | 8/2013 | Saunders |
| 8,523,659 | B2 | 9/2013 | Evans |
| 8,574,059 | B2 | 11/2013 | Rodgers et al. |
| 8,608,545 | B2 | 12/2013 | Arora et al. |
| 8,662,986 | B2 | 3/2014 | Rodgers et al. |
| 8,690,660 | B2 | 4/2014 | Saunders et al. |
| 8,696,434 | B2 | 4/2014 | Tsukahara |
| 8,790,169 | B2 | 7/2014 | Saunders |
| 8,851,974 | B2 | 10/2014 | Caputo et al. |
| 8,870,642 | B2 | 10/2014 | Leupp et al. |
| 8,882,578 | B2 | 11/2014 | Saunders |
| 8,961,291 | B2 | 2/2015 | Dias Pires et al. |
| 9,005,022 | B2 | 4/2015 | Saunders |
| 9,165,433 | B2 | 10/2015 | Caputo |
| 9,202,345 | B2 | 12/2015 | Zoltewicz et al. |
| 9,230,410 | B2 | 1/2016 | Saunders et al. |
| 9,245,421 | B2 | 1/2016 | Saunders et al. |
| 9,251,667 | B2 | 2/2016 | Marks et al. |
| 9,257,017 | B2 | 2/2016 | Saunders et al. |
| 9,262,895 | B2 | 2/2016 | Rodgers et al. |
| 9,275,524 | B2 | 3/2016 | Nicely |
| 9,299,224 | B2 | 3/2016 | Leupp |
| 9,311,781 | B2 | 4/2016 | Edwards |
| 9,349,251 | B2 | 5/2016 | Caputo et al. |
| 9,355,528 | B2 | 5/2016 | Nicely |
| 9,418,521 | B1 | 8/2016 | Henrick et al. |
| 9,424,720 | B2 | 8/2016 | Suda |
| 9,430,900 | B2 | 8/2016 | Zoltewicz et al. |
| 9,466,169 | B2 | 10/2016 | Basallo et al. |
| 9,633,506 | B2 | 4/2017 | Basallo et al. |
| 9,928,691 | B2 | 3/2018 | Olive |
| 10,013,855 | B2 | 7/2018 | Nakamura |
| 10,037,651 | B2 | 7/2018 | You et al. |
| 10,043,350 | B2 | 8/2018 | Gomez et al. |
| 10,204,473 | B2 | 2/2019 | Lenger |
| 10,339,761 | B2 | 7/2019 | Olive |
| 10,366,575 | B2 | 7/2019 | Visser |
| 10,388,112 | B2 | 8/2019 | You et al. |
| 10,417,877 | B2 | 9/2019 | Gomez et al. |
| 10,475,294 | B2 | 11/2019 | Gomez et al. |
| 10,643,431 | B2 | 5/2020 | Chesworth et al. |
| 10,672,220 | B2 | 6/2020 | Lenger |
| 10,706,664 | B2 | 7/2020 | Boese et al. |
| 10,769,888 | B2 | 9/2020 | You et al. |
| 10,957,161 | B2 | 3/2021 | Chesworth et al. |
| 11,551,508 | B2 * | 1/2023 | Marks ..... G07F 17/3213 |
| 2002/0119818 | A1 | 8/2002 | Savio et al. |
| 2003/0035346 | A1 | 2/2003 | Laughlin |
| 2003/0130034 | A1 | 7/2003 | Suganuma et al. |
| 2003/0157980 | A1 | 8/2003 | Loose et al. |
| 2003/0216165 | A1 | 11/2003 | Singer et al. |
| 2004/0023714 | A1 | 2/2004 | Asdale |
| 2004/0043815 | A1 | 3/2004 | Kaminkow |
| 2004/0137982 | A1 | 7/2004 | Cuddy et al. |
| 2004/0171417 | A1 | 9/2004 | Beaulieu et al. |
| 2006/0189369 | A1 | 8/2006 | Taylor |
| 2007/0060248 | A1 | 3/2007 | Rodgers et al. |
| 2007/0060275 | A1 | 3/2007 | Gilmore et al. |
| 2007/0129135 | A1 | 6/2007 | Marks et al. |
| 2008/0003278 | A1 | 1/2008 | Mondelo |
| 2008/0004532 | A1 | 1/2008 | Rubey et al. |
| 2008/0032784 | A1 | 2/2008 | Englman |
| 2008/0045298 | A1 | 2/2008 | Yoshizawa |
| 2008/0045320 | A1 | 2/2008 | Kato |
| 2008/0108431 | A1 | 5/2008 | Cuddy et al. |
| 2009/0239634 | A1 | 9/2009 | Nguyen |
| 2009/0291741 | A1 | 11/2009 | Schofield |
| 2010/0075737 | A1 | 3/2010 | Bluemel |
| 2010/0167815 | A1 | 7/2010 | Gagner et al. |
| 2010/0234092 | A1 | 9/2010 | Gomez et al. |
| 2010/0304832 | A1 | 12/2010 | Kup-Ferroth |
| 2012/0122532 | A1 | 5/2012 | Berman et al. |
| 2012/0178517 | A1 | 7/2012 | Montenegro et al. |
| 2014/0014186 | A1 | 1/2014 | Bhattacharya et al. |
| 2014/0141860 | A1 | 5/2014 | Meyer |
| 2014/0179396 | A1 | 6/2014 | Aoki et al. |
| 2014/0274292 | A1 | 9/2014 | Suda |
| 2014/0323198 | A1 | 10/2014 | Tuck |
| 2015/0031437 | A1 | 1/2015 | Gomez et al. |
| 2015/0170462 | A1 | 6/2015 | Berman et al. |
| 2015/0269809 | A1 | 9/2015 | Smith |
| 2015/0287269 | A1 | 10/2015 | Berman |
| 2015/0356833 | A1 | 12/2015 | Aoki et al. |
| 2016/0042597 | A1 | 2/2016 | Olive |
| 2017/0154498 | A1 | 6/2017 | Olive |
| 2018/0268655 | A1 | 9/2018 | Olive |
| 2018/0268659 | A1 | 9/2018 | Chesworth et al. |
| 2019/0236905 | A1 | 8/2019 | Washington et al. |
| 2019/0340880 | A1 | 11/2019 | You et al. |
| 2020/0105090 | A1 * | 4/2020 | Caputo ..... G07F 17/34 |
| 2020/0193778 | A1 | 6/2020 | Chesworth et al. |
| 2020/0279457 | A1 | 9/2020 | Chesworth et al. |
| 2020/0364982 | A1 | 11/2020 | You et al. |

FOREIGN PATENT DOCUMENTS

| | | |
|---|---|---|
| GB | 2144568 B | 9/1985 |
| GB | 2251112 A | 6/1992 |

(56) References Cited

OTHER PUBLICATIONS

Zodiac Lion Slot Machine Snapshots from YouTube Video posted Aug. 15, 2019.

* cited by examiner

SYSTEMS AND METHODS USING MODIFIABLE GAME ELEMENTS

CROSS-REFERENCE TO RELATED APPLICATIONS

This application claims the benefit of priority to U.S. Provisional Patent Application No. 63/054,530, filed Jul. 21, 2020, the contents of which are incorporated herein by reference in their entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2021, SG Gaming, Inc.

FIELD

The present disclosure relates generally to gaming systems, apparatus, and methods and, more particularly, to game elements modified based on one or more relationships with modifier elements.

BACKGROUND

The gaming industry depends upon player participation. Players are generally "hopeful" players who either think they are lucky or at least think they can get lucky—for a relatively small investment to play a game, they can get a disproportionately large return. To create this feeling of luck, a gaming apparatus relies upon an internal or external random element generator to generate one or more random elements such as random numbers. The gaming apparatus determines a game outcome based, at least in part, on the one or more random elements.

A significant technical challenge is to improve the operation of gaming apparatus and games played thereon, including the manner in which they leverage the underlying random element generator, by making them yield a negative return on investment in the long run (via a high quantity and/or frequency of player/apparatus interactions) and yet random and volatile enough to make players feel they can get lucky and win in the short run. Striking the right balance between yield versus randomness and volatility to create a feeling of luck involves addressing many technical problems, some of which can be at odds with one another. This luck factor is what appeals to core players and encourages prolonged and frequent player participation. As the industry matures, the creativity and ingenuity required to improve such operation of gaming apparatus and games grows accordingly.

Another significant technical challenge is to improve the operation of gaming apparatus and games played thereon by increasing processing speed and efficiency of usage of processing and/or memory resources. To make games more entertaining and exciting, they often offer the complexities of advanced graphics and special effects, multiple bonus features with different game formats, and multiple random outcome determinations per feature. The game formats may, for example, include picking games, reel spins, wheel spins, and other arcade-style play mechanics. Inefficiencies in processor execution of the game software can slow down play of the game and prevent a player from playing the game at their desired pace.

Yet another significant technical challenge is to provide a new and improved level of game play that uses new and improved gaming apparatus animations. Improved animations represent improvements to the underlying technology or technical field of gaming apparatus and, at the same time, have the effect of encouraging prolonged and frequent player participation.

SUMMARY

According to one aspect of the present disclosure, a gaming system comprises game-logic circuitry and a display device that presents a plurality of symbol positions and a plurality of modifier positions. The game-logic circuitry causes the display device to present a modifier outcome by randomly and selectively populating one or more modifier positions with at least one modifier symbol, and causes, in response to the modifier outcome including a first modifier symbol at a first modifier position, the display device to present an animation of one or more symbol positions being populated with a respective value-bearing symbol based at least partially on the first modifier symbol and the first modifier position, each value-bearing symbol having an award indicia visually indicating an award value associated with the respective value-bearing symbol and remaining locked at their respective symbol positions. The game-logic circuitry also increases, in response to at least one of the symbol positions being occupied by a preexisting value-bearing symbol prior to the modifier outcome, the award value of the preexisting value-bearing symbol, wherein the display device is configured to present an updated award indicia of the preexisting value-bearing symbol based on the increased award value, and removes, in response to a termination condition, any locked value-bearing symbols from the plurality of symbol positions and provide an aggregated award as a function of the award values indicated by the award indicia of the locked value-bearing symbols occupying the plurality of symbol positions. The gaming system may be incorporated into a single, freestanding gaming machine.

According to another aspect of the disclosure, a method of conducting a game using a gaming system including a display device and game-logic circuitry in communication with the display device is provided. The display device is configured to present a plurality of symbol positions and a plurality of modifier positions in communication with the display device. The method includes causing, by the game-logic circuitry, the display device to present a modifier outcome by randomly and selectively populating one or more modifier positions of the plurality of modifier positions with at least one modifier symbol, causing, by the game-logic circuitry and in response to the modifier outcome including a first modifier symbol of the at least one modifier symbol at a first modifier position of the one or more populated modifier positions, the display device to present an animation of one or more symbol positions of the plurality of symbol positions being populated with a respective value-bearing symbol based at least partially on the first modifier symbol and the first modifier position, each of the value-bearing symbols having an award indicia visually indicating an award value associated with the respective value-bearing symbol, wherein the value-bearing symbols remain locked at the respective symbol position, increasing, by the game-logic circuitry and in response to at least one of the one or more symbol positions being occupied by a locked value-bearing symbol prior to the modifier outcome, the award value of the locked value-bearing symbol, wherein the display device is configured to present an updated award indicia of the locked symbol based on the increased award value, and removing, by the game-logic circuitry and in response to a termination condition, any locked value-bearing symbols from the plurality of symbol positions and providing an aggregated award as a function of the award values indicated by the award indicia of the locked value-bearing symbols occupying the plurality of symbol positions.

According to yet another aspect of the present disclosure, a gaming system comprises gaming machine including a display device and game-logic circuitry in communication with the display device. The display device presents a plurality of symbol positions and a plurality of modifier positions. The game-logic circuitry causes the display device to present a modifier outcome by randomly and selectively populating one or more modifier positions of the plurality of modifier positions with at least one modifier symbol, causes, in response to the modifier outcome including a first modifier symbol of the at least one modifier symbol at a first modifier position of the one or more populated modifier positions, the display device to present an animation of one or more symbol positions of the plurality of symbol positions being populated with a respective value-bearing symbol based at least partially on the first modifier symbol and the first modifier position, each of the value-bearing symbols having an award indicia visually indicating an award value associated with the respective value-bearing symbol, wherein the value-bearing symbols remain locked at the respective symbol positions, increases, in response to at least one of the one or more symbol positions being occupied by a preexisting value-bearing symbol prior to the modifier outcome, the award value of the preexisting value-bearing symbol, wherein the display device is configured to present an updated award indicia of the preexisting value-bearing symbol based on the increased award value, and removes, in response to a termination condition, any locked value-bearing symbols from the plurality of symbol positions and provide an aggregated award as a function of the award values indicated by the award indicia of the locked value-bearing symbols occupying the plurality of symbol positions.

Additional aspects of the invention will be apparent to those of ordinary skill in the art in view of the detailed description of various embodiments, which is made with reference to the drawings, a brief description of which is provided below.

Figure 1:
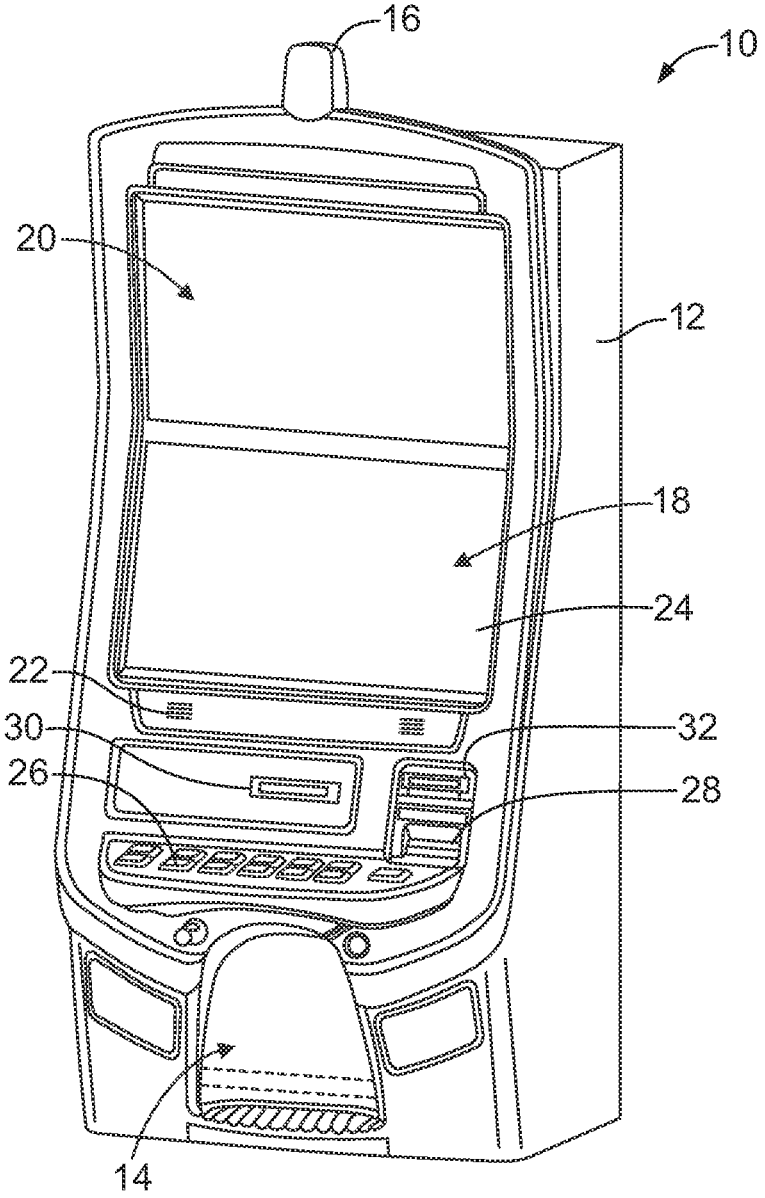
FIG. 1 is a perspective view of a free-standing gaming machine according to one or more embodiments of the present disclosure.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game involves wagers of real money, as found with typical land-based or online casino games. In other embodiments, the wagering game additionally, or alternatively, involves wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Embodiments of the present invention comprise an innovative application of data processing steps that, when implemented by game-logic circuitry, direct an electronic display device to present a symbol-value aggregation process that minimizes processing overhead by utilizing numbered indicia to represent credit values instead of complex, fanciful game images. Further, the process aggregates displayed values borne by special symbols (i.e., value-bearing symbols) according to stored, variable criteria. In this way, the value-bearing symbols provide building blocks for innumerable different aggregation sequences simply by manipulating the aggregation criteria associated with the value-bearing symbols, resulting in fewer rules needed for the aggregation process than would be necessary for calculating values of winning symbol combinations enumerated in stored paytables, as found in prior art reel-spinning routines. At the same time, embodiments of the present invention provide a straightforward, what-you-see-is-what-you-get (WYSIWYG) visual presentation that is simple to understand and, therefore, effective in generating player excitement and enthusiasm. The result is a highly flexible value-aggregation process that can be easily adapted to any theme/brand while remaining easily understood by players.

Referring to FIG. 1, there is shown a gaming machine 10 similar to those operated in gaming establishments, such as casinos. With regard to the present invention, the gaming machine 10 may be any type of gaming terminal or machine and may have varying structures and methods of operation. For example, in some aspects, the gaming machine 10 is an electromechanical gaming terminal configured to play mechanical slots, whereas in other aspects, the gaming machine is an electronic gaming terminal configured to play a video casino game, such as slots, keno, poker, blackjack, roulette, craps, etc. The gaming machine 10 may take any suitable form, such as floor-standing models as shown, handheld mobile units, bartop models, workstation-type console models, etc. Further, the gaming machine 10 may be primarily dedicated for use in playing wagering games, or may include non-dedicated devices, such as mobile phones, personal digital assistants, personal computers, etc. Exemplary types of gaming machines are disclosed in U.S. Pat. Nos. 6,517,433, 8,057,303, and 8,226,459, which are incorporated herein by reference in their entireties.

The gaming machine 10 illustrated in FIG. 1 comprises a gaming cabinet 12 that securely houses various input devices, output devices, input/output devices, internal electronic/electromechanical components, and wiring. The cabinet 12 includes exterior walls, interior walls and shelves for mounting the internal components and managing the wiring, and one or more front doors that are locked and require a physical or electronic key to gain access to the interior compartment of the cabinet 12 behind the locked door. The cabinet 12 forms an alcove 14 configured to store one or more beverages or personal items of a player. A notification mechanism 16, such as a candle or tower light, is mounted to the top of the cabinet 12. It flashes to alert an attendant that change is needed, a hand pay is requested, or there is a potential problem with the gaming machine 10.

The input devices, output devices, and input/output devices are disposed on, and securely coupled to, the cabinet 12. By way of example, the output devices include a primary display 18, a secondary display 20, and one or more audio speakers 22. The primary display 18 or the secondary display 20 may be a mechanical-reel display device, a video display device, or a combination thereof in which a transmissive video display is disposed in front of the mechanical-reel display to portray a video image superimposed upon the mechanical-reel display. The displays variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 10. The gaming machine 10 includes a touch screen(s) 24 mounted over the primary or secondary displays, buttons 26 on a button panel, a bill/ticket acceptor 28, a card reader/writer 30, a ticket dispenser 32, and player-accessible ports (e.g., audio output jack for headphones, video headset jack, USB port, wireless transmitter/receiver, etc.). It should be understood that numerous other peripheral devices and other elements exist and are readily utilizable in any number of combinations to create various forms of a gaming machine in accord with the present concepts.

The player input devices, such as the touch screen 24, buttons 26, a mouse, a joystick, a gesture-sensing device, a voice-recognition device, and a virtual-input device, accept player inputs and transform the player inputs to electronic data signals indicative of the player inputs, which correspond to an enabled feature for such inputs at a time of activation (e.g., pressing a "Max Bet" button or soft key to indicate a player's desire to place a maximum wager to play the wagering game). The inputs, once transformed into electronic data signals, are output to game-logic circuitry for processing. The electronic data signals are selected from a group consisting essentially of an electrical current, an electrical voltage, an electrical charge, an optical signal, an optical element, a magnetic signal, and a magnetic element.

The gaming machine 10 includes one or more value input/payment devices and value output/payout devices. In order to deposit cash or credits onto the gaming machine 10, the value input devices are configured to detect a physical item associated with a monetary value that establishes a credit balance on a credit meter such as the "credits" meter 84 (see FIG. 3). The physical item may, for example, be currency bills, coins, tickets, vouchers, coupons, cards, and/or computer-readable storage mediums. The deposited cash or credits are used to fund wagers placed on the wagering game played via the gaming machine 10. Examples of value input devices include, but are not limited to, a coin acceptor, the bill/ticket acceptor 28, the card reader/writer 30, a wireless communication interface for reading cash or credit data from a nearby mobile device, and a network interface for withdrawing cash or credits from a remote account via an electronic funds transfer. In response to a cashout input that initiates a payout from the credit balance on the "credits" meter 84 (see FIG. 3), the value output devices are used to dispense cash or credits from the gaming machine 10. The credits may be exchanged for cash at, for example, a cashier or redemption station. Examples of value output devices include, but are not limited to, a coin hopper for dispensing coins or tokens, a bill dispenser, the card reader/writer 30, the ticket dispenser 32 for printing tickets redeemable for cash or credits, a wireless communication interface for transmitting cash or credit data to a nearby mobile device, and a network interface for depositing cash or credits to a remote account via an electronic funds transfer.

Figure 2:
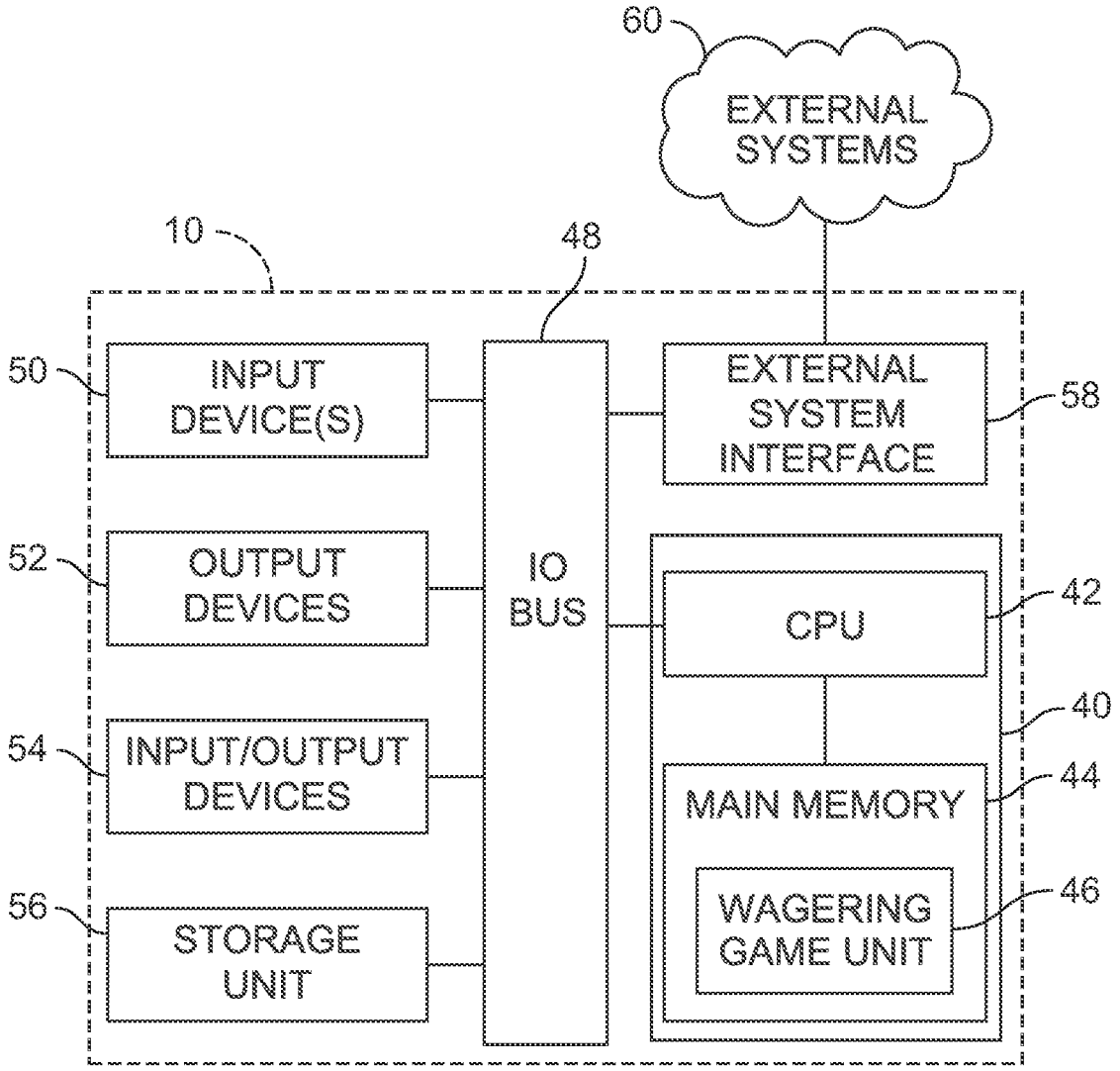
FIG. 2 is a schematic view of a gaming system according to one or more embodiments of the present disclosure.

Turning now to FIG. 2, there is shown a block diagram of the gaming-machine architecture. The gaming machine 10 includes game-logic circuitry 40 securely housed within a locked box inside the gaming cabinet 12 (see FIG. 1). The game-logic circuitry 40 includes a central processing unit (CPU) 42 connected to a main memory 44 that comprises one or more memory devices. The CPU 42 includes any suitable processor(s), such as those made by Intel and AMD. By way of example, the CPU 42 includes a plurality of microprocessors including a master processor, a slave processor, and a secondary or parallel processor. Game-logic circuitry 40, as used herein, comprises any combination of hardware, software, or firmware disposed in or outside of the gaming machine 10 that is configured to communicate with or control the transfer of data between the gaming machine 10 and a bus, another computer, processor, device, service, or network. The game-logic circuitry 40, and more specifically the CPU 42, comprises one or more controllers or processors and such one or more controllers or processors need not be disposed proximal to one another and may be located in different devices or in different locations. The game-logic circuitry 40, and more specifically the main memory 44, comprises one or more memory devices which need not be disposed proximal to one another and may be located in different devices or in different locations. The game-logic circuitry 40 is operable to execute all of the various gaming methods and other processes disclosed herein. The main memory 44 includes a wagering-game unit 46. In one embodiment, the wagering-game unit 46 causes wagering games to be presented, such as video poker, video blackjack, video slots, video lottery, etc., in whole or part.

The game-logic circuitry 40 is also connected to an input/output (I/O) bus 48, which can include any suitable bus technologies, such as an AGTL+ frontside bus and a PCI backside bus. The I/O bus 48 is connected to various input devices 50, output devices 52, and input/output devices 54 such as those discussed above in connection with FIG. 1. The I/O bus 48 is also connected to a storage unit 56 and an external-system interface 58, which is connected to external system(s) 60 (e.g., wagering-game networks).

The external system 60 includes, in various aspects, a gaming network, other gaming machines or terminals, a gaming server, a remote controller, communications hardware, or a variety of other interfaced systems or components, in any combination. In yet other aspects, the external system 60 comprises a player's portable electronic device (e.g., cellular phone, electronic wallet, etc.) and the external-system interface 58 is configured to facilitate wireless communication and data transfer between the portable electronic device and the gaming machine 10, such as by a near-field communication path operating via magnetic-field induction or a frequency-hopping spread spectrum RF signals (e.g., Bluetooth, etc.).

The gaming machine 10 optionally communicates with the external system 60 such that the gaming machine 10 operates as a thin, thick, or intermediate client. The game-logic circuitry 40—whether located within ("thick client"), external to ("thin client"), or distributed both within and external to ("intermediate client") the gaming machine 10—is utilized to provide a wagering game on the gaming machine 10. In general, the main memory 44 stores programming for a random number generator (RNG), game-outcome logic, and game assets (e.g., art, sound, etc.)—all of which obtained regulatory approval from a gaming control board or commission and are verified by a trusted authentication program in the main memory 44 prior to game execution. The authentication program generates a live authentication code (e.g., digital signature or hash) from the memory contents and compare it to a trusted code stored in the main memory 44. If the codes match, authentication is deemed a success and the game is permitted to execute. If, however, the codes do not match, authentication is deemed a failure that must be corrected prior to game execution. Without this predictable and repeatable authentication, the gaming machine 10, external system 60, or both are not allowed to perform or execute the RNG programming or game-outcome logic in a regulatory-approved manner and are therefore unacceptable for commercial use. In other words, through the use of the authentication program, the game-logic circuitry facilitates operation of the game in a way that a person making calculations or computations could not.

When a wagering-game instance is executed, the CPU 42 (comprising one or more processors or controllers) executes the RNG programming to generate one or more pseudo-random numbers. The pseudo-random numbers are divided into different ranges, and each range is associated with a respective game outcome. Accordingly, the pseudo-random numbers are utilized by the CPU 42 when executing the game-outcome logic to determine a resultant outcome for that instance of the wagering game. The resultant outcome is then presented to a player of the gaming machine 10 by accessing the associated game assets, required for the resultant outcome, from the main memory 44. The CPU 42 causes the game assets to be presented to the player as outputs from the gaming machine 10 (e.g., audio and video presentations). Instead of a pseudo-RNG, the game outcome may be derived from random numbers generated by a physical RNG that measures some physical phenomenon that is expected to be random and then compensates for possible biases in the measurement process. Whether the RNG is a pseudo-RNG or physical RNG, the RNG uses a seeding process that relies upon an unpredictable factor (e.g., human interaction of turning a key) and cycles continuously in the background between games and during game play at a speed that cannot be timed by the player, for example, at a minimum of 100 Hz (100 calls per second) as set forth in Nevada's New Gaming Device Submission Package. Accordingly, the RNG cannot be carried out manually by a human and is integral to operating the game.

The gaming machine 10 may be used to play central determination games, such as electronic pull-tab and bingo games. In an electronic pull-tab game, the RNG is used to randomize the distribution of outcomes in a pool and/or to select which outcome is drawn from the pool of outcomes when the player requests to play the game. In an electronic bingo game, the RNG is used to randomly draw numbers that players match against numbers printed on their electronic bingo card.

The gaming machine 10 may include additional peripheral devices or more than one of each component shown in FIG. 2. Any component of the gaming-machine architecture includes hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic-disk storage media, optical storage media, flash memory, etc.

Figure 3:
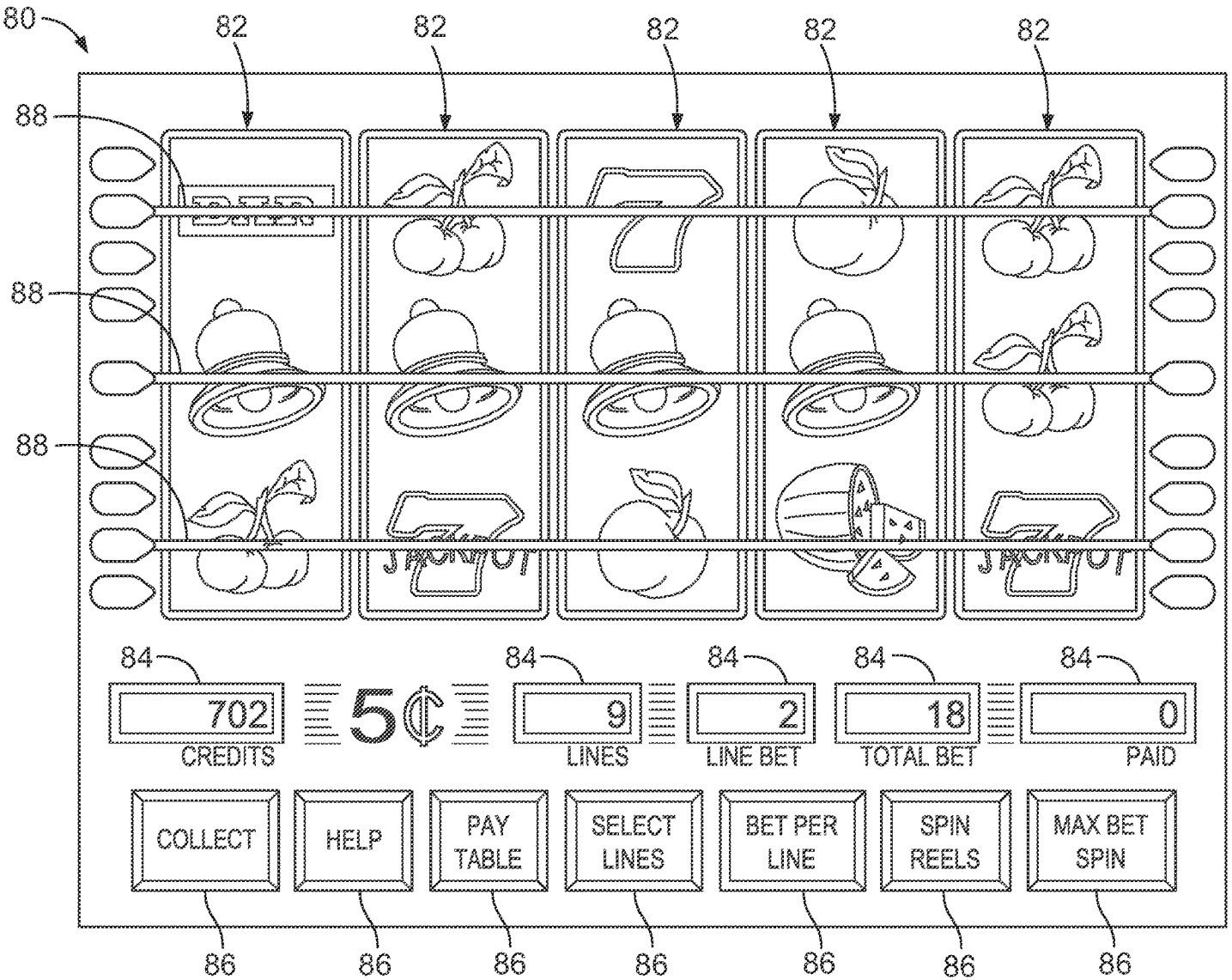
FIG. 3 is an image of an exemplary basic-game screen of a wagering game displayed on a gaming machine, according to one or more embodiments of the present disclosure.

Referring now to FIG. 3, there is illustrated an image of a basic-game screen 80 adapted to be displayed on the primary display 18 or the secondary display 20. The basic-game screen 80 portrays a plurality of simulated symbol-bearing reels 82. Alternatively or additionally, the basic-game screen 80 portrays a plurality of mechanical reels or other video or mechanical presentation consistent with the game format and theme. The basic-game screen 80 also advantageously displays one or more game-session credit meters 84 and various touch screen buttons 86 adapted to be actuated by a player. A player can operate or interact with the wagering game using these touch screen buttons or other input devices such as the buttons 26 shown in FIG. 1. The game-logic circuitry 40 operates to execute a wagering-game program causing the primary display 18 or the secondary display 20 to display the wagering game.

In response to receiving an input indicative of a wager covered by or deducted from the credit balance on the "credits" meter 84, the reels 82 are rotated and stopped to place symbols on the reels in visual association with paylines such as paylines 88. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering-game outcome is provided or displayed in response to the wager being received or detected. The wagering-game outcome, for that particular wagering-game instance, is then revealed to the player in due course following initiation of the wagering game. The method comprises the acts of conducting the wagering game using a gaming apparatus, such as the gaming machine 10 depicted in FIG. 1, following receipt of an input from the player to initiate a wagering-game instance. The gaming machine 10 then communicates the wagering-game outcome to the player via one or more output devices (e.g., primary display 18 or secondary display 20) through the display of information such as, but not limited to, text, graphics, static images, moving images, etc., or any combination thereof. In accord with the method of conducting the wagering game, the game-logic circuitry 40 transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the game-logic circuitry 40 is configured to process the electronic data signal, to interpret the data signal (e.g., data signals corresponding to a wager input), and to cause further actions associated with the interpretation of the signal in accord with stored instructions relating to such further actions executed by the controller. As one example, the CPU 42 causes the recording of a digital representation of the wager in one or more storage media (e.g., storage unit 56), the CPU 42, in accord with associated stored instructions, causes the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM, etc.). The noted second state of the data storage media comprises storage in the storage media of data representing the electronic data signal from the CPU 42 (e.g., the wager in the present example). As another example, the CPU 42 further, in accord with the execution of the stored instructions relating to the wagering game, causes the primary display 18, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of the stored instructions relating to the wagering game is further conducted in accord with a random outcome (e.g., determined by the RNG) that is used by the game-logic circuitry 40 to determine the outcome of the wagering-game instance. In at least some aspects, the game-logic circuitry 40 is configured to determine an outcome of the wagering-game instance at least partially in response to the random parameter.

In one embodiment, the gaming machine 10 and, additionally or alternatively, the external system 60 (e.g., a gaming server), means gaming equipment that meets the hardware and software requirements for fairness, security, and predictability as established by at least one state's gaming control board or commission. Prior to commercial deployment, the gaming machine 10, the external system 60, or both and the casino wagering game played thereon may need to satisfy minimum technical standards and require regulatory approval from a gaming control board or commission (e.g., the Nevada Gaming Commission, Alderney Gambling Control Commission, National Indian Gaming Commission, etc.) charged with regulating casino and other types of gaming in a defined geographical area, such as a state. By way of non-limiting example, a gaming machine in Nevada means a device as set forth in NRS 463.0155, 463.0191, and all other relevant provisions of the Nevada Gaming Control Act, and the gaming machine cannot be deployed for play in Nevada unless it meets the minimum standards set forth in, for example, Technical Standards 1 and 2 and Regulations 5 and 14 issued pursuant to the Nevada Gaming Control Act. Additionally, the gaming machine and the casino wagering game must be approved by the commission pursuant to various provisions in Regulation 14. Comparable statutes, regulations, and technical standards exist in other gaming jurisdictions. As can be seen from the description herein, the gaming machine 10 may be implemented with hardware and software architectures, circuitry, and other special features that differentiate it from general-purpose computers (e.g., desktop PCs, laptops, and tablets).

In at least some of the foregoing systems and methods described herein, value-bearing symbols (i.e., symbols having a visible indication of the symbol's value) and modifier elements are incorporated to one or more game features. For example, the modifier elements may be associated with one or more symbol positions within the symbol array, and triggering a modifier element may cause the associated symbol positions to receive new value-bearing symbols and/or modify existing value-bearing symbols.

Figure 4:
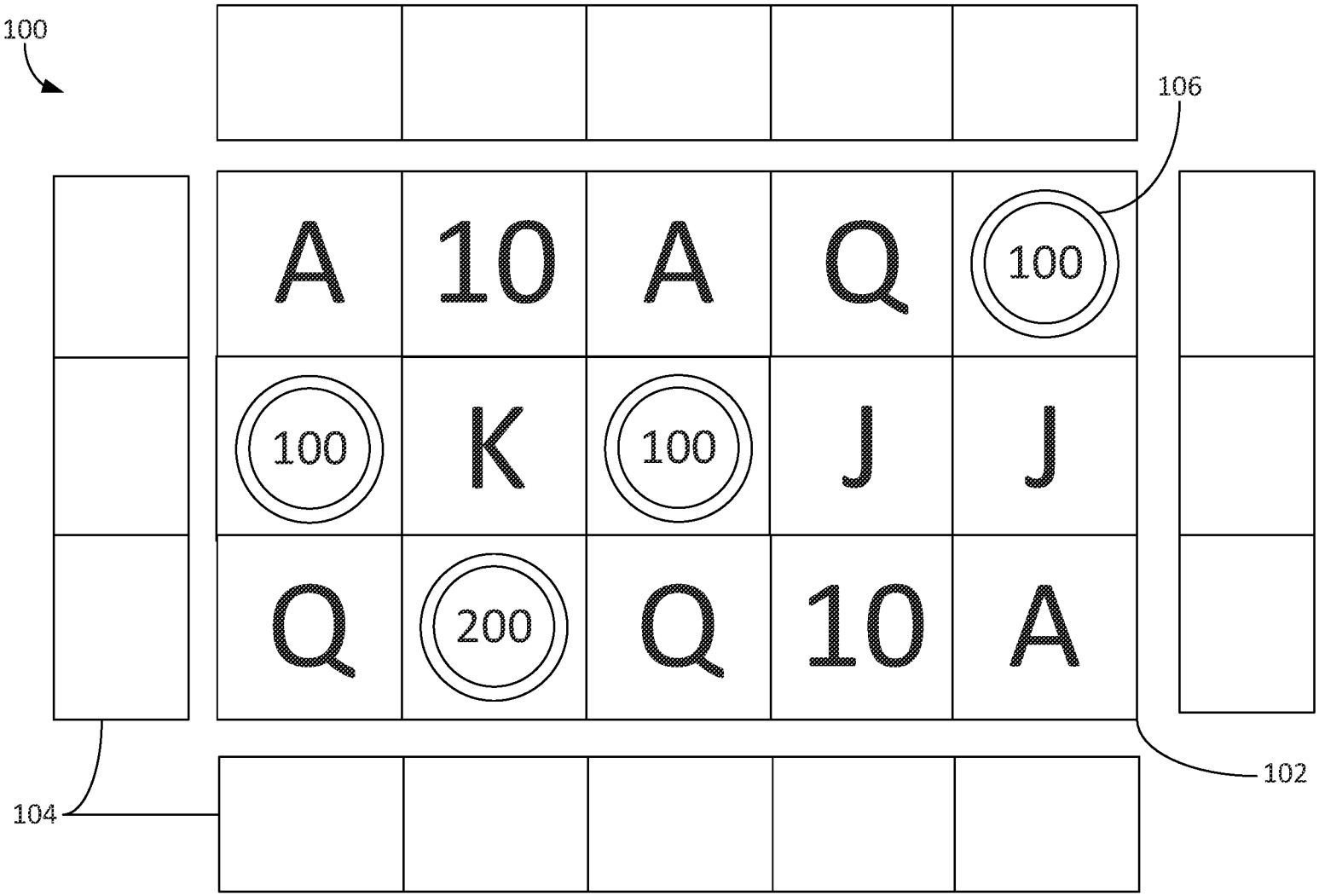
FIG. 4 is an exemplary game interface with modifier elements displayed on a gaming machine, according to one or more embodiments of the present disclosure.

FIG. 4 is an example game interface 100 presented by a gaming machine (such as the machine 10, shown in FIG. 1). The game interface 100 may be a graphical interface, a mechanical interface, and/or a hybrid interface (i.e., some of the graphical elements may be digitally displayed, while other elements are mechanical). The game interface 100 may be presented by a single display device (e.g., the primary display 18, shown in FIG. 1) or a combination of display devices. The interface 100 includes a symbol array 102 and a plurality of modifier positions 104 positioned around the symbol array 102. In other embodiments, the interface 100 may include additional, fewer, or alternative elements, including those described elsewhere herein.

The symbol array 102 includes a plurality of symbol positions for presenting a plurality of symbols. In the example embodiment, the symbol array 102 is arranged in a plurality of rows and columns of symbol positions. In other embodiments, the symbol array 102 may be in a different suitable configuration, such as a circle divided into a plurality of wedges and/or rings of symbol positions. In some embodiments, the symbol positions are populated using symbol reels comprising a plurality of symbols. Each symbol reel is associated with one or more symbol positions at which one or more of the symbols of the symbol reel is visible. In one example, each symbol reel is associated with a respective column of the symbol array 102. A subset of symbols from each symbol reel may be selected to populate the associated symbol position(s). In other embodiments, the symbol positions may not be populated using symbol reels, but rather are populated using another suitable repository of symbols. The symbol population may be random or partially random such that a symbol is selected at least partially as a function of one or more randomly generated numbers.

The population sequence may be initiated in response to one or more triggers, such as a player providing user input at the gaming machine (e.g., pressing a 'spin' button) or completion of a prior game cycle. The trigger conditions for the game play cycle causes the game-logic circuitry (e.g., the circuitry 40, shown in FIG. 2) to generate an outcome for the game play cycle. For at least some game features, such as the game feature shown in FIG. 3, the generated outcome populates the symbol array 102 with a plurality of symbols and determines whether the symbols populating the array 102 result in a winning outcome, bonus trigger, and/or other suitable indicators for one or more features of the game.

In the example embodiment, the symbol positions may be populated with several types of symbols. The symbols may include, but are not limited to, regular symbols, special symbols (e.g., wild symbols), and/or value-bearing symbols 106. The value-bearing symbols 106 are symbols including a value indicia or watermark that visibly indicates the value of the respective value-bearing symbol 106. Although the illustrated embodiment depicts the value-bearing symbols 106 as coins with text indicating the value, other embodiments may include alternative graphics to visually distinguish the value-bearing symbols 106 and their respective value. In some embodiments, the value-bearing symbols 106 may be treated as a special or regular symbol when determining if a winning outcome from a scatter pay table or a payline has been achieved. In other embodiments, the value-bearing symbols 106 may not factor into scatter or payline winning outcomes. In such embodiments, the value-bearing symbols 106 may be applied to a bonus game feature described herein.

The value of each value-bearing symbol 106 may be fixed or dynamic. That is, each value-bearing symbol 106 may begin at the same value (e.g., 100 credits), or the value-bearing symbols 106 may have different values. For example, one value-bearing symbol 106 has a credit value of '200', while the remaining three value-bearing symbols 106 have a credit value of '100'. The value of each value-bearing symbol 106 may be based on one or more factors, including, but not limited to, a randomly generated value, wager frequency, wager amount, historical game data, historical player data, and the like.

In the example embodiment, the modifier positions 104 are separated into four distinct sets. Each set is positioned adjacent to a respective border of the symbol array 102 such that each modifier position is aligned with a row or column of the symbol array 102. In other embodiments, alternative configurations of the modifier positions 104 may be used. For example, the modifier positions 104 may be combined into a single, continuous set. In another example, the modifier positions 104 may only border one or two sides of the symbol array 102 such that each modifier position is uniquely aligned with a symbol position or a column or row. In yet another example, at least some of the modifier positions 104 may not be organized similar to the symbol array 102, such as a modifier position 104 aligned across a diagonal of the symbol array 102.

In the example embodiment, the game associated with the game interface 100 has at least two game features: a base game feature and a bonus game feature. The base game feature includes populating the symbol array 102 with a plurality of symbols and determining any winning outcomes based on the symbols populating the array 102 (e.g., similar to the game shown in FIG. 3). The bonus game feature is triggered based on one or more conditions from the base game feature and incorporates the value-bearing symbols 106 and modifier elements (not shown in FIG. 4) within the modifier positions 104. In other embodiments, the game may have a different suitable configuration, such as aspects of the bonus game feature described herein being incorporated within or replacing the base game feature. For example, and without limitation, the modifier positions 104 may be selectively populated during the base game feature to award free plays, add symbols to the symbol array 102 (e.g., wild symbols, multipliers, etc.), or modify existing symbols within the array 102.

In the example embodiment, FIG. 4 depicts an outcome from the base game feature that triggers the bonus game feature. More specifically, the number of value-bearing symbols 106 populating the symbol array 102 has met or exceeded a trigger threshold. It is to be understood that although the four illustrated value-bearing symbols have met the trigger threshold in the example embodiment, other embodiments may require additional or fewer value-bearing symbols. In certain embodiments, additional and/or alternative conditions may factor in triggering the bonus game feature. For example, a wager amount and/or frequency may be factored into the trigger conditions of the bonus game feature.

Figure 5:
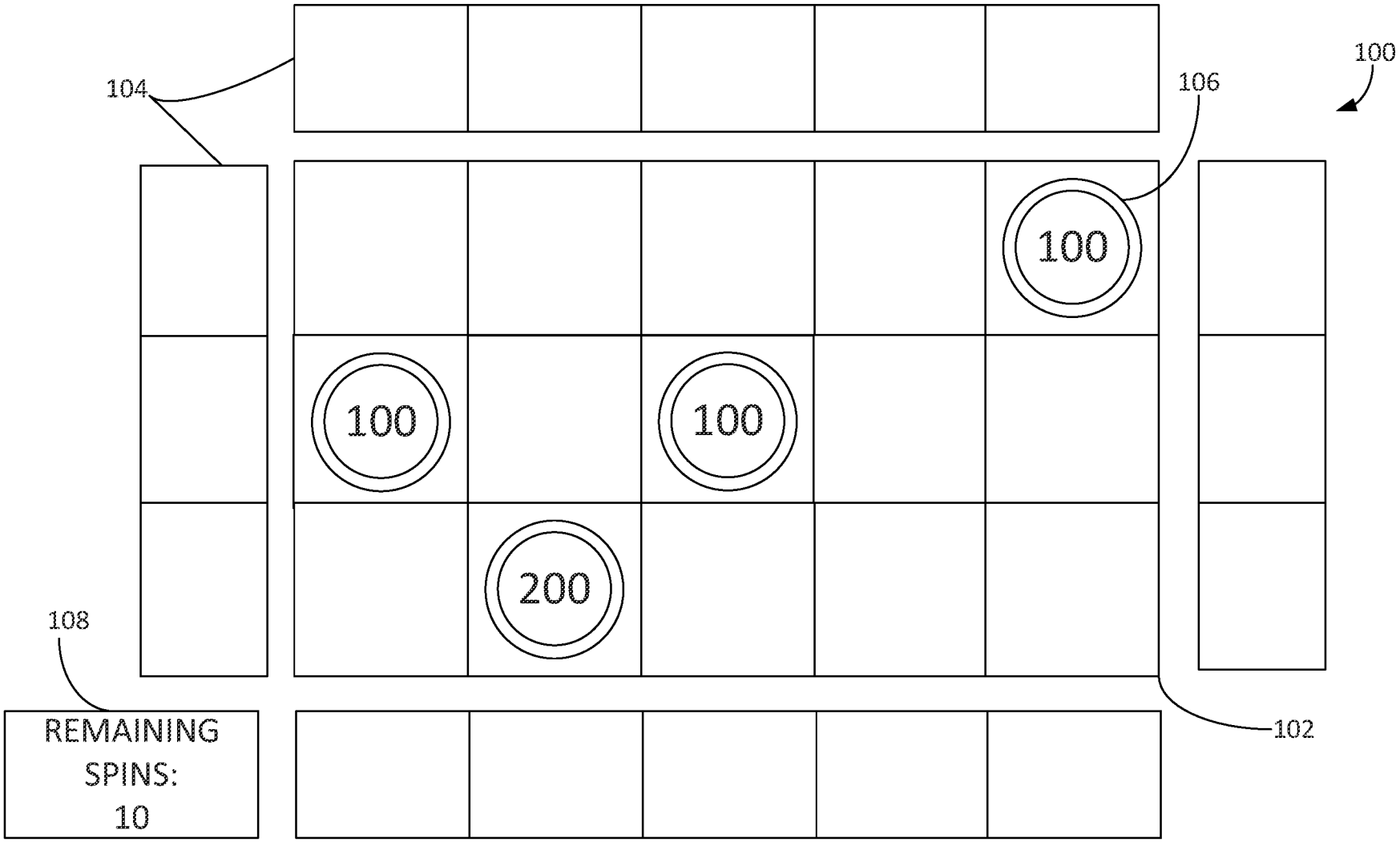
FIG. 5 is the game interface of FIG. 4 in an initialized state of an example bonus feature using modifier elements, according to one or more embodiments of the present disclosure.

FIG. 5 depicts the interface 100 at an example initial state of the bonus game feature. In the example initial state, all symbols other than the value-bearing symbols 106 have been removed from the symbol array 102 and the value-bearing symbols 106 remain in the symbol positions from the triggering state shown in FIG. 4. In other embodiments, the value-bearing symbols 106 may be moved around within the symbol array 102, and/or other symbols may remain in the array 102.

In the example embodiment, the bonus game feature has a limited duration. That is, a number of outcomes (also referred to as 'game cycles', 'cycles', or 'spins') is provided at the initial state of the bonus game feature. Upon the number of remaining outcomes reaching zero, the bonus game feature is concluded, and the base game feature (or another game feature) resumes. In at least some embodiments, additional spins or outcomes may be awarded during the bonus game feature as described herein. In the example embodiment, at the initial state of the bonus game feature, ten spins are allocated as indicated by a spins indicator 108. In other embodiments, the initial state of the bonus game feature may allocated a different, suitable number of spins.

The spins may be automatically initiated or manually initiated (i.e., the player provides user input to initiate the next spin). Similar to the base game feature, the game-logic circuitry generates an outcome as described herein and causes the display device presenting the game interface 100 to animate one or more elements of the interface 100 to reflect the generated outcome.

Figure 6A:
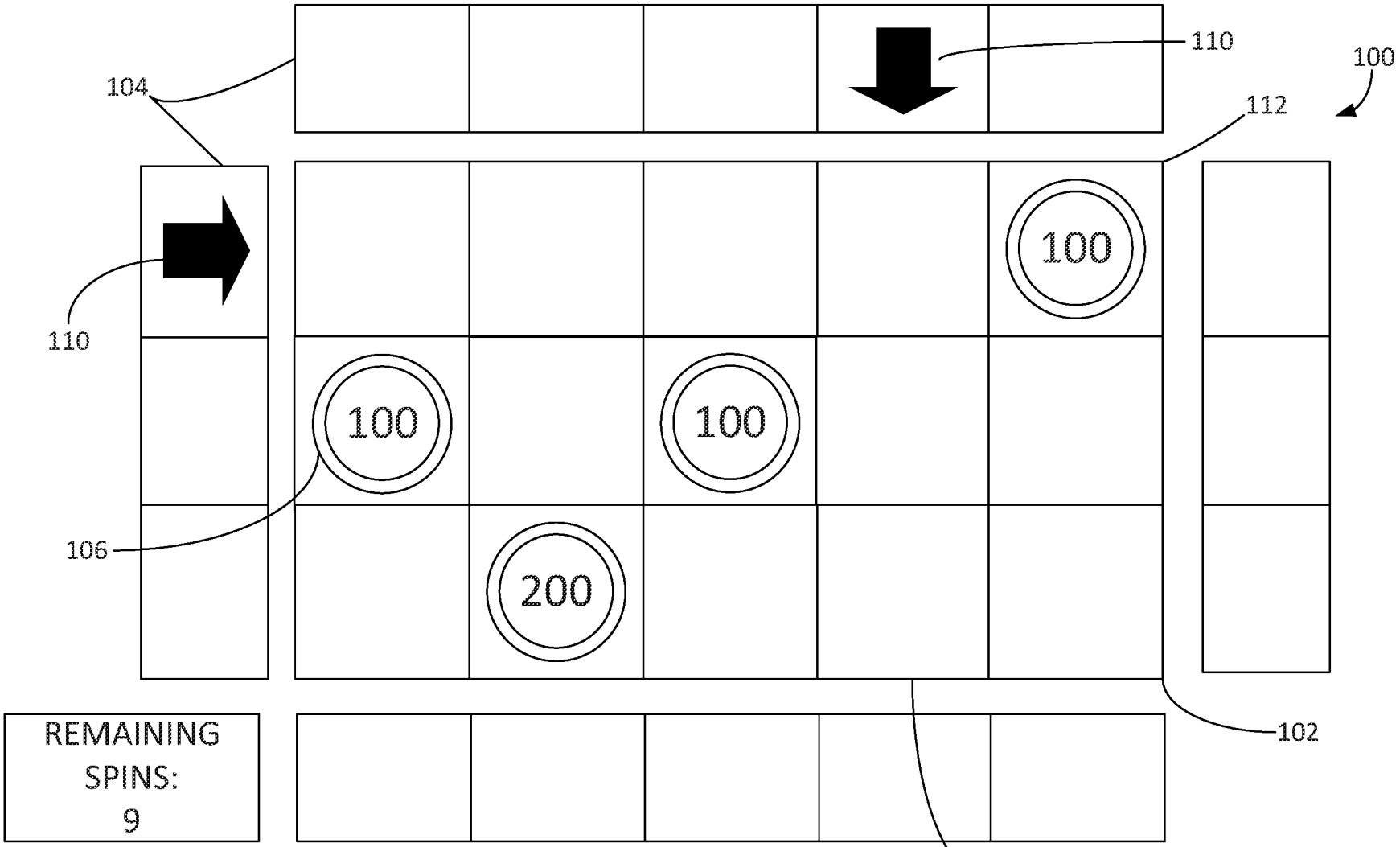
FIG. 6A is the game interface of FIG. 4 depicting an exemplary first stage of a bonus game outcome, according to one or more embodiments of the present disclosure.
Figure 6B:
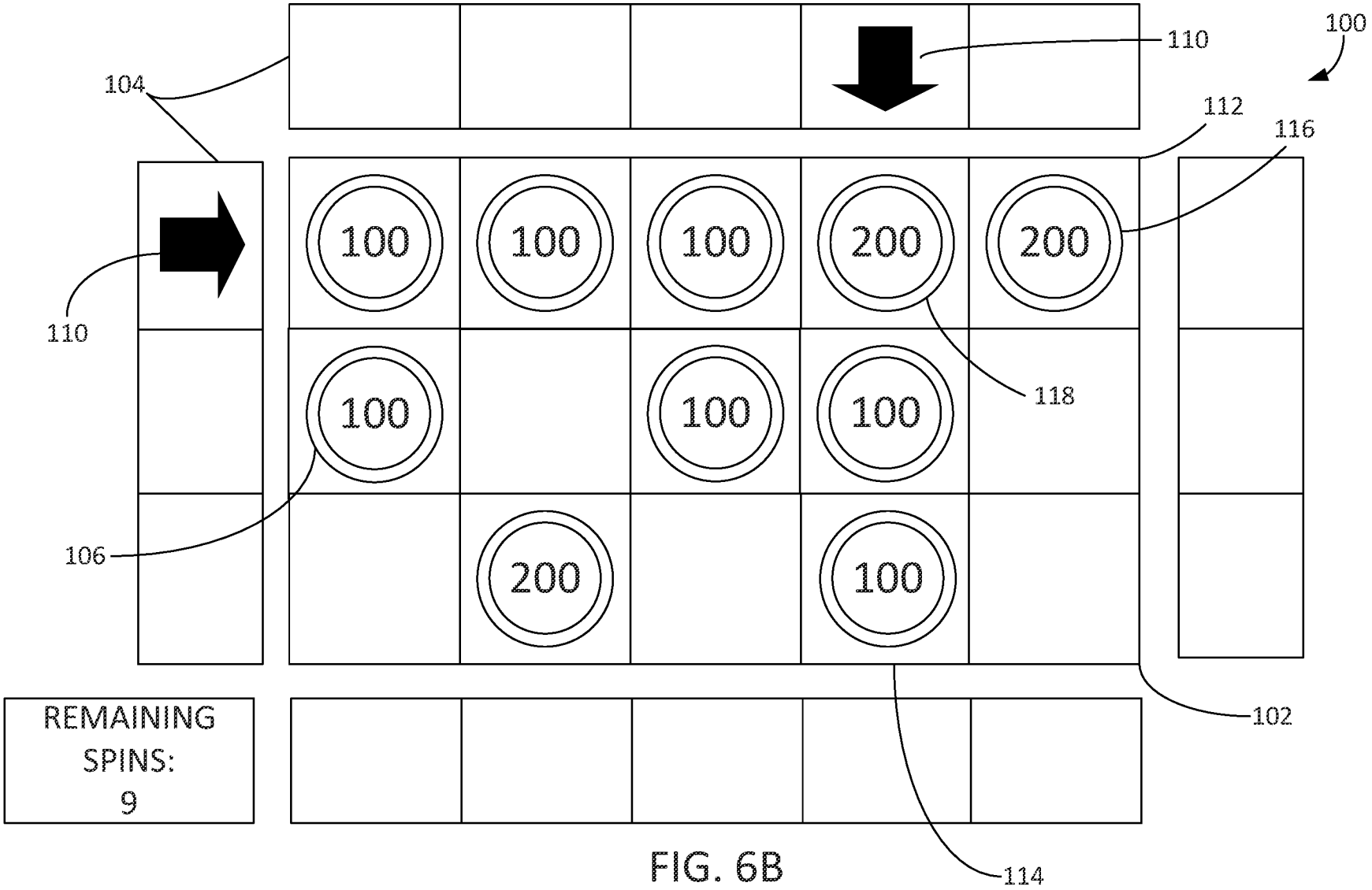
FIG. 6B is the game interface of FIG. 6A depicting an exemplary second stage of the bonus game outcome, according to one or more embodiments of the present disclosure.

FIGS. 6A and 6B depict an example outcome state of the bonus game feature. More specifically, FIG. 6A depicts a first stage of the outcome state, and FIG. 6B depicts a second stage of the outcome state that proceeds the first stage.

In the example embodiment, the symbol array 102 remains fixed. That is, the value-bearing symbols 106 remain locked in the same symbol positions, and the empty symbol positions are not populated with symbols from the symbol reels of the base game feature. Rather, the modifier positions 104 are selectively populated with one or more modifier symbols 110. The modifier symbols 110 include symbols that, when populating a modifier position, may affect one or more symbol positions of the symbol array 102 as described herein. The modifier symbols 110 may include other symbols, such as symbols that award additional spins or a jackpot bonus and symbols that have no effect (i.e., "blank symbols"). In some embodiments, the modifier positions 104 are associated with one or more reel strips including modifier symbols 110 such that the modifiers symbols 110 presented within the modifier positions are selected from the associated reel strip. In other embodiments, other suitable forms of random selection may be used to selective which (if any) modifier symbol 110 populates a respective modifier position 104.

In the example embodiment, the modifier symbols 110 include arrow symbols. The arrows (broadly referred to as "direction indicia") visually indicate which, if any, symbol positions are associated with the modifier symbol 110 at a particular modifier position 104. For example, the leftmost modifier symbol 110 in FIG. 6A is associated with the top row 112 of the symbol array 102, whereas the other modifier symbol 110 is associated with the fourth column 114 from the left of the array 102. Although the arrows are depicted as pointing towards the array 102, in other embodiments, the arrows may selectively point in directions away from the symbol array 102 such that the arrow symbol is not associated with any symbol positions of the symbol array 102.

In the example embodiment, each outcome of the bonus game feature may include modifier symbols 110 in some, all, or none of the modifier positions 104. That is, an outcome may include no modifier symbols 110. In certain embodiments, the modifier symbols 110 include blank 'symbols' instead of blank positions that function the same as blank positions. The modifier symbols 110 may be selected for generating the outcome from one or more underlying reels of the modifier positions 104 or randomly from a set of modifier symbols. In one example, each of the four sets of modifier positions 104 is associated with a separate reel strip including modifier symbols 110 and blank positions. The game-logic circuitry may cause the display device to animate the modifier symbols 110 to create the appearance of the modifier symbols 110 spinning or moving through the modifier positions 104.

With respect now to FIG. 6B, the effect of modifier symbols 110 on the array 102 is shown. More specifically, in the example embodiment, each symbol position associated with a modifier symbol 110 is populated with a value-bearing symbol 106, and the value of each existing value-bearing symbol 106 within these symbol positions is modified. The arrow of the leftmost modifier symbol 110 aligns with the first row of the symbol array 102. As a result, the empty symbol positions of the top row are populated with value-bearing symbols and the value of the existing value-bearing symbol 116 is modified. The newly added value-bearing symbols 106 may have a predetermined value, or the value may be dynamic (e.g., the initial value of each value-bearing symbol 106 may be selected from a range of values). In the example embodiment, each new value-bearing symbol 106 has a value of 100 credits with the exception of an intersecting value-bearing symbol 118 as described herein.

The modified value of the existing value-bearing symbol 116 may result in an increase in the value of the symbol 116. The modification may be the result of a mathematical operation (e.g., the value of a newly added value-bearing symbol 106 is added to or multiplied with the existing value of the value-bearing symbol 116) or a selection from a table of values. For example, Table 1 below illustrates an example set of values, where each value represents an additional upgrade to the value of the symbol 116. Each upgrade is achieved from bonus game outcomes including modifier symbols 110 associated with the symbol position of the value-bearing symbol 116. In other embodiments, other suitable methods of modifying the value of the value-bearing symbol 116 may be used, including random selection of a value from a set of values or generating a value at least partially as a function of a randomly generated value. In one example, the modifier symbol 110 may not be limited to arrows, but may also include a visual indicator of a modifier parameter that may be used in determining the upgraded value of the value-bearing symbol 116. That is, the modifier symbol may include visual indication (e.g., text, color, graphical element, etc.) of a multiplier, a credit value, and/or other suitable value that may be incorporated into a mathematical function or other determination of the upgraded value. In certain embodiments, the modification may not result in the value-bearing symbol 116 having an increased value, but rather the value-bearing symbol 116 may gain additional or alternative awards, such as, and without limitation, progressive jackpot awards, multipliers, and the like. In some embodiments, the modification may be based on factors external to the bonus game feature, such as wager amount and/or frequency in the base game feature.

TABLE 1

| Upgrade Level | Value |
|---|---|
| 1 (Initial) | 100 |
| 2 | 200 |
| 3 | 400 |
| 4 | 500 |
| 5 | 800 |
| 6 | 1000 |

Similar to the top row 112, the fourth column 114 is populated with value-bearing symbols 106. In the example embodiment, any value-bearing symbols 106 at an intersection of two or more modifier symbols 110 may stack the effects of the modifier symbols 110. That is, the intersecting value-bearing symbol 118 is both added to the array 102 and then modified based on the two modifier symbols 110. The order in which the effects of the modifier symbols 110 are applied to the intersecting value-bearing symbol 118 may be inconsequential (i.e., the resulting value is the same either way), or a hierarchy or order may be established to govern which modifier symbol 110 is applied to the symbol array 102 first. For example, in some embodiments, the modifier symbols 110 may include additional elements that affect population and modification of the symbol array, such as value indicia used to generate new value-bearing symbols 106 and modify existing value-bearing symbols 112. The hierarchy may be based on these additional elements and/or modifier position 104 of each modifier symbol 110. The animation of adding and modifying the value-bearing symbols 106 may reflect the order by presenting the animation associated with each modifier symbol 110 in series.

In other embodiments, the value-bearing symbols 106 are added and/or modified on the symbol array 102 in response to a combination of the modifier symbols 110. For example, using the illustrated graphical elements in FIG. 6B, the logic-circuitry may be configured to add or modify value-bearing symbols 106 at symbol positions that intersect two or more of the arrow modifier symbols 110. That is, in FIG. 6B, rather than populating the entire first row 112 and fourth column 114 with value-bearing symbols, the only symbol position that is populated with a value-bearing symbol is the symbol position in the first row 112 and fourth column 114 (i.e., the top symbol position in the fourth column 114). This intersection of arrow modifier symbols 110 may not be limited to a single symbol position of the array 102. For example, if the modifier outcome includes two opposing arrow modifier symbols 110 facing each other, then the row or column associated with the opposing arrow modifier symbols 110 may be populated in its entirety. In other embodiments, other suitable combinations of modifier symbols and/or modifier positions beyond intersecting arrows may be implemented, include combinations that have no positional relationship to each other. For example, colors or graphical elements may be used to link together a plurality of modifier symbols and/or positions with one or more symbol positions in the symbol array 102.

In some embodiments, the modifier symbols 110 may affect the symbol array 102 in response to one or more activation conditions. That is, modifier symbols of a bonus game outcome may not affect the symbol array 102 unless an activation condition has been met. In one example, the game interface may include an activation graphical element (not shown). The activation graphical element may be included within the symbol array 102, the modifier positions 104, the symbols of the array 102 (including the value-bearing symbols 106), the modifier symbols, 110, and/or external to the elements shown in FIG. 6B. As an example, the activation graphical element may indicate one or more arrow directions as 'active' or 'inactive' for at least the current outcome. In another example, the modifier symbols 110 may include a color or other identifier in addition to the arrows that the activation graphical element identifies as being inactive or active.

In at least some embodiments, the modifier symbols 110 may not be limited to blanks and arrow symbols. In one example, the modifier symbols 110 include free spin symbols. The free spin symbols may not affect the symbol array 102, but rather award one or more additional spins within the bonus game feature to the player. The free spins symbols may reset the remaining spins to a predetermined value or add to the current count of remaining spins. In certain embodiments, the modifier symbols 110 may include additional or alternative symbols with the arrow symbols and free spin symbols.

Figure 7:
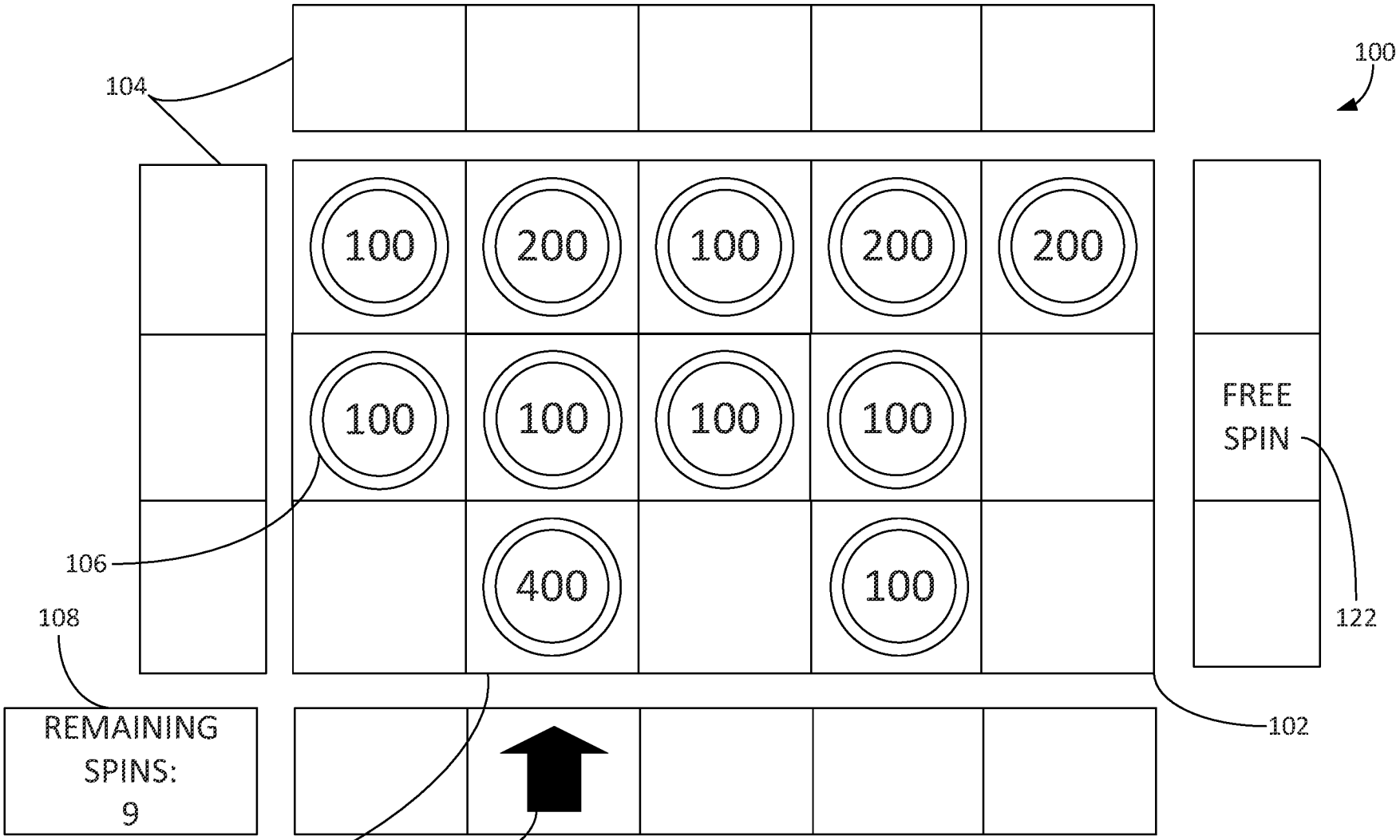
FIG. 7 is the game interface of FIG. 4 depicting an exemplary bonus game outcome subsequent the bonus stage outcome shown in FIGS. 6A and 6B, according to one or more embodiments of the present disclosure.

FIG. 7 depicts a subsequent bonus outcome following the outcome depicted by FIGS. 6A and 6B. In this subsequent outcome, two modifier symbols 110 are present: one arrow symbol associated with the second column 120, and a free spins symbol 122. As a result of the arrow symbol, the blank space of the second column 120 (in the second row) has been populated with a new value-bearing symbol 106, and the existing value-bearing symbols 106 in the second column 120 have been modified to include upgraded award values. In this example, the modified amounts correspond to the values shown in Table 1 above.

The free spins symbol 122 does not affect the symbol array 102, but rather affects the current count of spins shown by the spins indicator 108. That is, the free spins symbol 122, when present in a bonus game outcome, may be applied to the current count of spins irrespective of the modifier position 104 in which it lands. In other embodiments, the free spins symbol 122 may be associated with one or more activation conditions that must be met to award the additional spin or spins. For example, the free spins symbol 122 may require an arrow modifier symbol 110 be intersecting it to be activated. In other embodiments, these activation conditions may not determine whether or not the free spins symbol 122 is active or inactive, but rather the extent of the awarded free spins. As an example, the intersection with an arrow modifier symbol 110 may increase the number of free spins awarded rather than activating the free spins symbol 122.

In the example embodiment, the free spins symbol 122 awards one additional free spin. As shown by the spins indicator 108 in FIGS. 6A and 6B, the number of remaining spins prior to the outcome shown in FIG. 7 is nine. At the outcome shown in FIG. 7, the remaining spins should be decremented to eight remaining spins. However, the free spins symbol 122 adds one additional spin, thereby causing the remaining spins to stay at nine. The display device may be configured to animate the spins indicator 108 and/or the free spins symbol 122 to reflect the decrement of a remaining spin and/or the addition of a free spin. Outcomes including multiple free spins symbols 122 may apply the free spin awards similar to the modifications to value-bearing symbols 106 by multiple arrow modifier symbols 110. That is, each free spins symbol 122 may be independently added to the remaining spins count, or the number of free spins added may be based on the combination of the free spins symbols 122 (e.g., as a mathematical function of the symbols 122 or a selection from a set of free spins awards based on the number of free spins symbols 122).

In the example embodiment, the bonus game feature shown in FIGS. 5-7 may continue until the number of remaining spins (i.e., a termination condition) has reached zero. In other embodiments, such as embodiments in which the game feature described above is not a bonus game feature, other suitable termination conditions may be used (e.g., credit balance reaching zero, a player-initiated card-out, etc.). At the termination condition, an award is provided based on the value indicia of the value-bearing symbols 106 locked within the array 102. More specifically, in the example embodiment, the award is aggregated from the award values of the value-bearing symbols 106 locked within the array 102. For example, if bonus game feature ended with the value-bearing symbols 106 shown in FIG. 7, the award value would be aggregated to 1700 credits.

The locked value-bearing symbols 106 may then be removed or unlocked from the array and the base game feature is initiated, thereby concluding the bonus game feature until the trigger conditions of the bonus game feature (e.g., a threshold number of value-bearing symbols 106 in abase game outcome being met or exceeded) occurs. It is to be understood that 'unlocking' the value-bearing symbols 106 may include one or more animations that remove the value-bearing symbols 106 from the array 102. For example, the initial spin animation of the base game feature may cause the value-bearing symbols 106 may include the unlocked value-bearing symbols 106 moving off the array 102 as part of the spin animation. In other embodiments, other suitable animations may be presented by the display device to indicate the value-bearing symbols 106 have been removed. For example, presenting the award for the bonus game feature to the player may include one or more animations of the value-bearing symbols 106 being removed as the associated award values are aggregated together.

In certain embodiments, the value-bearing symbols 106 may be removable prior to termination conditions being met for the bonus game feature. For example, the value-bearing symbols 106 may have a max award value or max number of modifications or upgrades, and reaching this number may cause one or more value-bearing symbols 106 to be awarded to the player prior to conclusion of the bonus game. In another example, a modifier symbol 110 may cause one or more value-bearing symbols 106 to be removed. In such an example, the removal of the value-bearing symbols 106 may or may not include providing an aggregated award to the player for the removed value-bearing symbols 106.

In some embodiments, multiple termination conditions may be available to conclude the bonus game feature. For example, the value-bearing symbols 106 may be configured to provide opportunities to the player to win a progressive jackpot award and then conclude the bonus game feature. In this example, the value-bearing symbols 106 may be modified or upgraded a number of times before the value-bearing symbols 106 trigger one or more progressive jackpot awards rather than a predetermined credit amount. The progressive jackpot awards may be in response to a predetermined number (including one) of value-bearing symbols 106 achieving this level of upgrades, or another suitable method of achieving a progressive award may be used. As another example, each population or modification of value-bearing symbols 106 within the symbol array may include a random chance that the award value is changed to a progressive jackpot award (or a trigger for a progressive jackpot award). In another example, the progressive jackpot award may not be tied to the value-bearing symbols, but rather is tied to one or more modifier symbols 110. In other embodiments, achieving a progressive jackpot award may not terminate the bonus game feature prior to the number of remaining spins reaching zero.

Figure 8:
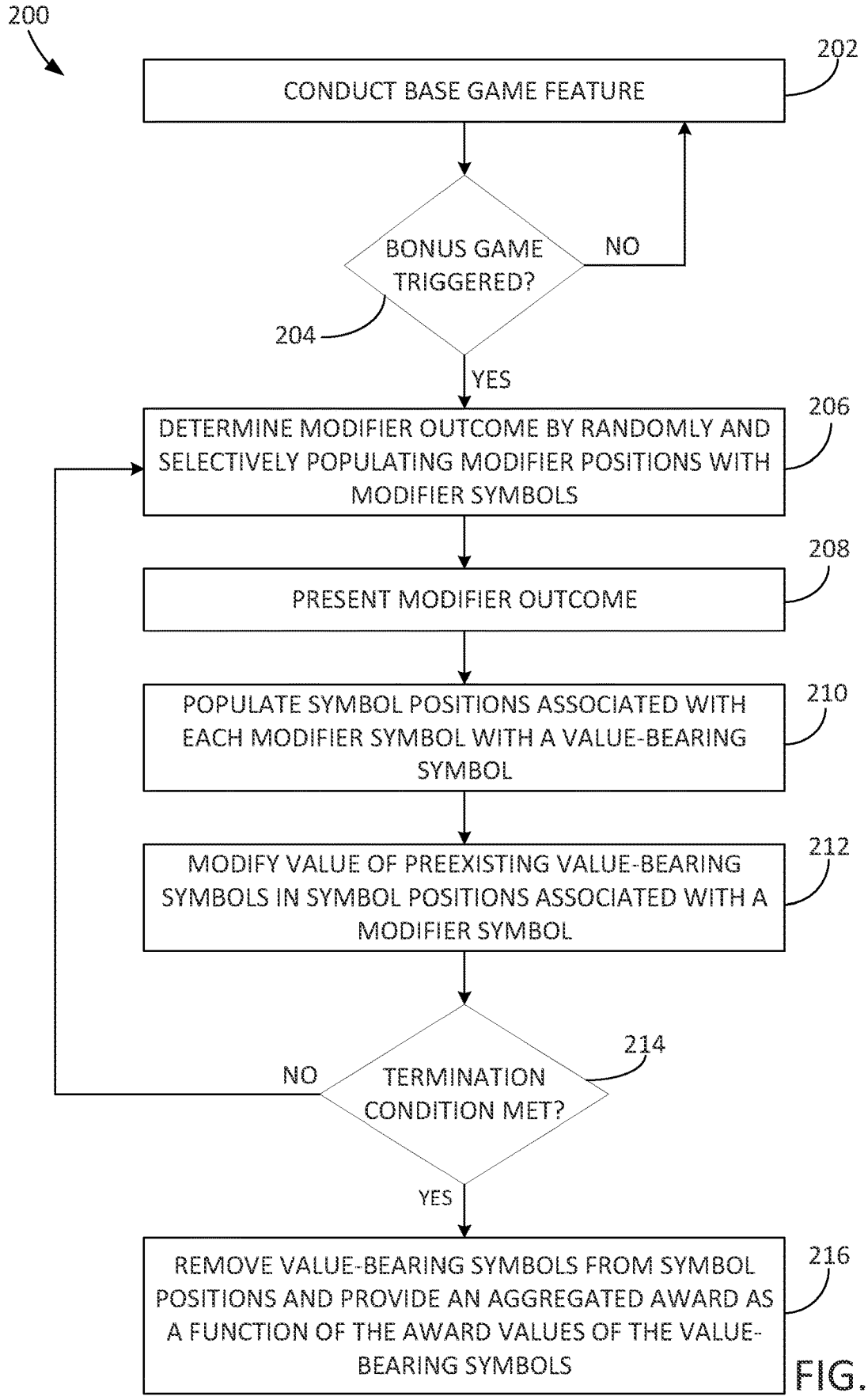
FIG. 8 is a flow diagram of an exemplary method of conducting a wagering game in accord with at least some aspects of the disclosed concepts.

FIG. 8 is a flow diagram of an example method 200 for conducting a game with modifiable game elements. The method 200 may be at least partially performed by game-logic circuitry (e.g., the logic-circuitry 40, shown in FIG. 2) in combination with one or more display devices configured to present a game interface having a symbol array and a plurality of modifier positions. It is to be understood that the symbol array described herein is one configuration of a plurality of symbol positions and that other suitable configurations of the symbols positions may be used in place of or in combination with the symbol array. Other suitable devices may be used to perform one or more steps of the method 200 in addition to or instead of the logic circuitry. In other embodiments, the method 200 may include additional, fewer, or alternative steps, including those described elsewhere herein.

In the example embodiment, the game includes two game features: a base game feature and a bonus game feature. While the steps of the method 200 described herein are primarily focused on the bonus game feature, the steps may be incorporated into the base game feature and/or the game may have a different configuration of game features (including configurations in which the game includes a single game feature incorporating the steps of the method 200 described herein).

In the example embodiment, the logic circuitry conducts 202 the base game feature. The base game feature may include, for example, populating the symbol array with a plurality of randomly selected symbols. These symbols may include base game symbols (i.e., symbols that can form winning outcomes within the base game feature), special symbols, value-bearing symbols, and/or other suitable symbols. The logic circuitry causes the display device to present animations reflecting base game outcomes and/or other events of the base game feature as determined by the logic circuitry. For wagering games, these events may include, for example, a player providing a credit input to fund a credit balance and/or the player providing user input (e.g., to submit a wager or select an option associated with the game). In response to a base game outcome, the logic circuitry may determine 204 whether trigger conditions for the bonus game feature have been met. In the example embodiment, the trigger condition is the base game outcome including at least a threshold number of value-bearing symbols. In other embodiments, the trigger condition may include additional or alternative conditions within the base game feature, such as a wager frequency, wager amount, or play time. If the trigger conditions have not been met, the logic circuitry may continue to conduct 202 the base game feature. However, if the trigger conditions are met, the bonus game feature is initiated.

At the initiation of the bonus game feature, some or all of the symbols from the base game feature may be removed from the symbol array. The value-bearing symbols present at the initiation of the bonus game feature may be locked into the symbol array while other symbols are removed. The logic circuitry may cause the display device to present one or more animations that reflect the change to the bonus game feature such as, and without limitation, the removal of the symbols from the array and/or the locking of the value-bearing symbols to the array.

In the example embodiment, the bonus game feature is initiated within a predetermined number of spins or outcomes allocated. In response to each spin, the number of remaining spins is decremented while the outcome of the spin (i.e., the "bonus game outcome" or "modifier outcome") is applied to the symbol array and/or other aspect of the bonus game feature. More specifically, the logic circuitry determines 206 a modifier outcome by randomly and selectively populating one or more modifier positions external the symbol array with modifier symbols. Each modifier outcome may include no modifier symbols, one modifier symbol, or a plurality of modifier symbols such that some or all of the modifier positions may be left unoccupied or blank. The logic circuitry causes the display device to present 208 the modifier outcome and any animation depicting transitions to and/or from the modifier outcome.

If the modifier outcome includes any modifier symbols that affect the symbol array, the logic circuitry may populate 210 one or more unoccupied symbol positions (i.e., symbol positions that do not include locked value-bearing symbols) associated with each modifier symbol with a value-bearing symbol. The association between symbol positions and modifier symbols may be based on, but is not limited to, one or more parameters of the modifier symbols (e.g., a direction indicia that may point towards one or more symbol positions), the modifier position occupied by the modifier symbols, and/or the location of the symbol positions relative to the modifier positions within the game interface. These value-bearing symbols may then be locked to their respective symbol positions until the bonus game feature is concluded or another condition is met for removal of the value-bearing symbols.

If one or more symbol positions associated with a modifier symbol of the modifier outcome is already occupied by a value-bearing symbol (e.g., a value-bearing symbol from the trigger condition of the bonus game feature or a value-bearing symbol added from a previous modifier outcome), the award value associated with the existing value-bearing symbol is modified 212. This modification may be any suitable upgrade or alteration to the award value of the value-bearing symbol, and may include, for example, a mathematical operation applied to the existing award value and/or selection of a new award value from a set of values (e.g., the values shown in Table 1). For some symbol positions that are associated with a plurality of modifier symbols of the modifier outcome, these symbol positions may be included in both the populating 210 and modifying 212 steps within a single modifier outcome. That is, a value-bearing symbol populates 210 the symbol position for a first modifier symbol, and then this value-bearing symbol is modified 212 for each subsequent modifier symbol associated with the symbol position.

In certain embodiments, the modifier outcome may include other types of modifier symbols that have different effects than populating the symbol positions or modifying value-bearing symbols. For example, one type of modifier symbol may award additional free spins or outcomes for the bonus game feature if present in the modifier outcome. In another example, another modifier symbol may be associated with a progressive jackpot award. In a further example, the modifier symbols may include a modifier symbol that does not directly affect the award values of the value-bearing symbols but rather has another effect, such as, and without limitation, shifting the value-bearing symbol to a new symbol position, combining value-bearing symbols (and their associated award values), multiplying or changing a subsequent modification to the value-bearing symbol, and/or activating a parameter of the value-bearing symbol for progressive jackpot awards.

The game-logic circuitry causes the display device to present these game elements and associated animations to enable the player to visibly identify the effect of the modifier outcome. For example, the display device may present the new value-bearing symbols through an animation that indicates which modifier symbol is associated with the population, and similarly, each modification may indicate which modifier symbol is associated with the modification. The award values of the value-bearing symbols are visibly presented as value indicia to indicate to the player the expected award values in a clear and concise manner.

In the example embodiment, in response to determining the modifier outcome, the game-logic circuitry determines 214 whether or not termination conditions for the bonus game feature have been met. More specifically, in the example embodiment, the game-logic circuitry determines if the number of remaining free spins or outcomes has been met a predetermined termination threshold (e.g., zero). Other suitable termination conditions may also be compared to the current game state to determine whether or not the bonus game feature is to conclude. If the determination 214 indicates that the termination condition has not been met, then the bonus game feature with subsequent modifier outcomes. For each modifier outcome, the game-logic circuitry may update one or more values that count or track the termination condition. These values may be presented via the display device (e.g., a remaining spins counter) to enable the player to track progress through the bonus game feature.

If the determination 214 indicates that the termination condition has been met, the bonus game feature concludes using an award sequence before resuming the base game feature. More specifically, the game-logic circuitry causes the display device to remove 216 or unlock the value-bearing symbols from the symbol positions and provides an aggregated award as a function of the award values of the value-bearing symbols. The aggregated award may simply be the summed value of the award values or another suitable mathematical operation may be applied using the award values of value-bearing symbols to calculate the aggregated award. The game-logic circuitry may cause the display device to present one or more animations associated with the award sequence. For example, calculating the aggregated award may include animations of the value indicia of value-bearing symbol being summed together. As another example, the value-bearing symbols may be removed immediately after the aggregated award animation or may be unlocked such that the value-bearing symbols appear to be part of the reel strips or other set of symbols in the base game feature, thereby removing the value-bearing symbols from the symbol positions during the first spin animation of the base game feature. It is to be understood that these examples are for illustrative purposes only and are not intended to limit the scope of the animations of the award sequence.

The embodiments of the present invention provide an innovative procedure for modifying and aggregating values of symbols in a plurality of symbol positions (e.g., within a symbol array). Game-logic circuitry executing instructions in accordance with the embodiments present a visual display of externally modifiable symbols in symbol positions with clearly enumerated symbology that combine in readily understood arrangements to increase in value. An observer experiences excitement and anticipation as new symbols land in the array and aggregate values are summed and displayed. In stark contrast to conventional reel-spinning games in which symbol images are evaluated for winning combinations by paytable rules, the disclosed embodiments provide immediately recognizable values in WYSIWYG display configurations while adding variability as to how the values to be awarded to the player are selected and accumulated.

The value population, modification, and/or aggregation procedures may be symbol- and game-agnostic. Themes and imagery of symbols and environment may be varied with no effect on the value-aggregation process. Or, if so desired, the criteria for these procedures may be modified in innumerable ways to produce new visual/animation effects and exciting summation sequences.

Further benefits are realized in increased computer processing efficiency, fewer rules to be evaluated, and simpler graphical representations. For example, in a conventional paytable evaluation, overlapping payline sections require multiple evaluation steps. Often, analysis is required to determine which payline results in the highest credit total, with the lesser value paylines being discarded but only after being evaluated-all this adds to processing overhead. Special symbols like wilds, multipliers, and scatter symbols can modify paytable values and may require separate, additional evaluation according to customized rule sets. All these procedures can be inherently more complex than simple aggregation (i.e., addition) of number values. The embodiments disclosed herein represents a win-win: simpler, almost self-explanatory graphics combined with faster, more efficient processing. The inventive value-aggregation procedure can be implemented on the vast majority of casino gaming machines without requiring upgrades or modifications.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

The invention claimed is:

1. A gaming machine comprising:

a display device configured to present a plurality of symbol positions in a symbol array and a plurality of modifier positions external to the symbol array; and game-logic circuitry in communication with the display device, the game-logic circuitry configured to:

cause the display device to present a modifier outcome by randomly and selectively, populating one or more modifier positions of the plurality of modifier positions with at least one modifier symbol;

in response to the modifier outcome including a first modifier symbol of the at least one modifier symbol at a first modifier position of the one or more populated modifier positions, cause the display device to present an animation of one or more symbol positions of the plurality of symbol positions being populated with a respective value-bearing symbol based at least partially on the first modifier symbol and the first modifier position, each of the value-bearing symbols having an award indicia visually indicating an award value associated with the respective value-bearing symbol, wherein the value-bearing symbols remain locked at the respective symbol positions and the symbols within the symbol array remain fixed between modifier outcomes;

in response to at least one of the one or more symbol positions being occupied by a preexisting value-bearing symbol prior to the modifier outcome, increase the award value of the preexisting value-bearing symbol, wherein the display device is configured to present an updated award indicia of the preexisting value-bearing symbol based on the increased award value; and in response to a termination condition, remove any locked value-bearing symbols from the plurality of symbol positions and provide an aggregated award as a function of the award values indicated by the award indicia of the locked value-bearing symbols occupying the plurality of symbol positions.

2. The gaming machine of claim 1, wherein the first modifier symbol includes a direction indicia visually linking the first modifier position to the one or more symbol positions.

3. The gaming machine of claim 2, wherein the plurality of symbol positions are arranged in the symbol array within a plurality of rows and a plurality of columns, wherein the first modifier symbol occupying the first modifier position is associated with one row or one column of the symbol array.

4. The gaining machine of claim 3, wherein the display device presents the plurality of modifier positions along one or more borders of the symbol array.

5. The gaming machine of claim 2, wherein the association between the first modifier position and the one or more symbol positions is determined based at least partially on the direction indicia of the first modifier symbol and a location of the first modifier position relative to a location of the one or more symbol positions presented by the display device.

6. The gaming machine of claim 1, wherein the at least one modifier symbol comprises the first modifier symbol and a second modifier symbol, the second modifier symbol awarding at least one of a number of free plays or one or more modifiers for the value-bearing symbols in response to the modifier outcome including the second modifier symbol.

7. The gaming machine of claim 1, wherein, in response to the modifier outcome including the first modifier symbol at the first modifier position and a second modifier symbol at a second modifier position of the plurality of modifier positions, (i) a first symbol position of the one or more symbol positions is populated with a value-bearing symbol or (ii) the award value of a preexisting value-bearing symbol occupying the first symbol position is increased, the first symbol position associated with at least one of the first modifier position or the first modifier symbol and at least one of the second modifier position or the second modifier symbol.

8. The gaming machine of claim 1, wherein the game-logic circuitry is configured to provide a bonus game feature including the modifier outcome and the value-bearing symbols, the termination condition including a number of remaining free plays reaching zero.

9. A method of conducting a game using a gaming system including a display device and game-logic circuitry in communication with the display device, wherein the display device is configured to present a plurality of symbol positions in a symbol array and a plurality of modifier positions external to the symbol array, the method comprising:

causing, by the game-logic circuitry, the display device to present a modifier outcome by randomly and selectively populating one or more modifier positions of the plurality of modifier positions with at least one modifier symbol;

in response to the modifier outcome including a first modifier symbol of the at least one modifier symbol at a first modifier position of the one or more populated modifier positions, causing, by the game-logic circuitry, the display device to present an animation of one or more symbol positions of the plurality of symbol positions being populated with a respective value-bearing symbol based at least partially on the first modifier symbol and the first modifier position, each of the value-bearing symbols having an award indicia visually indicating an award value associated with the respective value-bearing symbol, wherein the value-bearing symbols remain locked at the respective symbol positions and the symbols within the symbol array remain fixed between modifier outcomes;

in response to at least one of the one or more symbol positions being occupied by an preexisting value-bearing symbol prior to the modifier outcome, increasing, by the game-logic circuitry, the award value of the preexisting value-bearing symbol, wherein the display device is configured to present an updated award indicia of the preexisting value-bearing symbol based on the increased award value; and in response to a termination condition, removing, by the game-logic circuitry, any locked value-bearing symbols from the plurality of symbol positions and providing an aggregated award as a function of the award values indicated by the award indicia of the locked value-bearing symbols occupying the plurality of symbol positions.

10. The method of claim 9, wherein the first modifier symbol includes a direction indicia visually linking the first modifier position to the one or more symbol positions.

11. The method of claim 10, wherein the plurality of symbol positions are arranged in the symbol array within a plurality of rows and a plurality of columns, wherein the first modifier symbol occupying the first modifier position is associated with one row or one column of the symbol array.

12. The method of claim 11, wherein the display device presents the plurality of modifier positions along one or more borders of the symbol array.

13. The method of claim 10, wherein the association between the first modifier position and the one or more symbol positions is determined based at least partially on the direction indicia of the first modifier symbol and a location of the first modifier position relative to a location of the one or more symbol positions presented by the display device.

14. The method of claim 9, wherein the at least one modifier symbol comprises the first modifier symbol and a second modifier symbol, the second modifier symbol awarding at least one of a number of free plays or one or more modifiers for the value-bearing symbols in response to the modifier outcome including the second modifier symbol.

15. The method of claim 9, wherein, in response to the modifier outcome including the first modifier symbol at the first modifier position and a second modifier symbol at a second modifier position of the plurality of modifier positions, (i) a first symbol position of the one or more symbol positions is populated with a value-bearing symbol or (ii) the award value of a preexisting value-bearing symbol occupying the first symbol position is increased, the first symbol position associated with at least one of the first modifier position or the first modifier symbol and at least one of the second modifier position or the second modifier symbol.

16. The method of claim 9, wherein the game-logic circuitry is configured to provide a bonus game feature including the modifier outcome and the value-bearing symbols, the termination condition including a number of remaining free plays reaching zero.

17. A gaming system comprising:

a gaming machine comprising a display device configured to present a plurality of symbol positions in a symbol array and a plurality of modifier positions external to the symbol array; and game-logic circuitry in communication with the display device, the game-logic circuitry, configured to:

cause the display device to present a modifier outcome by randomly and selectively, populating one or more modifier positions of the plurality of modifier positions with at least one modifier symbol;

in response to the modifier outcome including a first modifier symbol of the at least one modifier symbol at a first modifier position of the one or more populated modifier positions, cause the display device to present an animation of one or more symbol positions of the plurality of symbol positions being populated with a respective value-bearing symbol based at least partially on the first modifier symbol and the first modifier position, each of the value-bearing symbols having an award indicia visually indicating an award value associated with the respective value-bearing symbol, wherein the value-bearing symbols remain locked at the respective symbol positions and the symbols within the symbol array remain fixed between modifier outcomes;

in response to at least one of the one or more symbol positions being occupied by a preexisting value-bearing symbol prior to the modifier outcome, increase the award value of the preexisting value-bearing symbol, wherein the display device is configured to present an updated award indicia of the preexisting value-bearing symbol based on the increased award value; and in response to a termination condition, remove any locked value-bearing symbols from the plurality of symbol positions and provide an aggregated award as a function of the award values indicated by the award indicia of the locked value-bearing symbols occupying the plurality of symbol positions.

18. The gaming system of claim 17, wherein the first modifier symbol includes a direction indicia visually linking the first modifier position to the one or more symbol positions.

19. The gaming system of claim 18, wherein the plurality of symbol positions are arranged in the symbol array within a plurality of rows and a plurality of columns, wherein the first modifier symbol occupying the first modifier position is associated with one row or one column of the symbol array.

20. The gaming system of claim 19, wherein the display device presents the plurality of modifier positions along one or more borders of the symbol array.

21. The gaming system of claim 18, wherein the association between the first modifier position and the one or more symbol positions is determined based at least partially on the direction indicia of the first modifier symbol and a location of the first modifier position relative to a location of the one or more symbol positions presented by the display device.

22. The gaming system of claim 17, wherein the at least one modifier symbol comprises the first modifier symbol and a second modifier symbol, the second modifier symbol awarding at least one of a number of free plays or one or more modifiers for the value-beating symbols in response to the modifier outcome including the second modifier symbol.

23. The gaming system of claim 17, wherein, in response to the modifier outcome including the first modifier symbol at the first modifier position and a second modifier symbol at a second modifier position of the plurality of modifier positions, (i) a first symbol position of the one or more symbol positions is populated with a value-bearing symbol or (ii) the award value of a preexisting value-bearing symbol occupying the first symbol position is increased, the first symbol position associated with at least one of the first modifier position or the first modifier symbol and at least one of the second modifier position or the second modifier symbol.

24. The gaming system of claim 17, wherein the game-logic circuitry is configured to provide a bonus game feature including the modifier outcome and the value-beating symbols, the termination condition including a number of remaining free plays reaching zero.

* * * * *